US007431160B2

(12) United States Patent
Drought et al.

(10) Patent No.: US 7,431,160 B2
(45) Date of Patent: Oct. 7, 2008

(54) APPARATUS FOR RELEASING TABLETS FROM A BLISTER PACK

(75) Inventors: Nicholas Andrew Murray Drought, Cambridge (GB); Stephen Blatcher, Cambridgeshire (GB); Ian Michael Daines Gaylor, Cambridgeshire (GB); Mark Stacey Rowbotham, Hertfordshire (GB)

(73) Assignee: Gruenenthal GmbH, Aachen (DE)

( * ) Notice: Subject to any disclaimer, the term of this patent is extended or adjusted under 35 U.S.C. 154(b) by 306 days.

(21) Appl. No.: 10/531,139

(22) PCT Filed: Oct. 13, 2003

(86) PCT No.: PCT/GB03/04396

§ 371 (c)(1),
(2), (4) Date: Sep. 16, 2005

(87) PCT Pub. No.: WO2004/034952

PCT Pub. Date: Apr. 29, 2004

(65) Prior Publication Data

US 2006/0138014 A1 Jun. 29, 2006

(30) Foreign Application Priority Data

Oct. 12, 2002 (GB) ..... 0223798.0

(51) Int. Cl.
*B65D 85/42* (2006.01)
*B65D 83/04* (2006.01)
*B65D 1/09* (2006.01)

(52) U.S. Cl. ..... 206/528; 206/531; 221/88

(58) Field of Classification Search ..... 206/528, 206/531–534, 534.1, 534.2, 538, 539; 221/87–89, 221/25, 71, 76
See application file for complete search history.

(56) References Cited

U.S. PATENT DOCUMENTS

| | | | | | |
|---|---|---|---|---|---|
| 4,015,717 | A | * | 4/1977 | Richardson et al. | 206/534 |
| 5,082,114 | A | * | 1/1992 | Bunin | 206/539 |
| 5,348,158 | A | * | 9/1994 | Honan et al. | 206/531 |
| 5,431,283 | A | * | 7/1995 | Weinstein et al. | 206/531 |
| 5,853,101 | A | * | 12/1998 | Weinstein | 220/284 |
| 5,988,429 | A | * | 11/1999 | Coe | 221/25 |
| 6,082,544 | A | * | 7/2000 | Romick | 206/531 |
| 6,155,454 | A | * | 12/2000 | George et al. | 221/25 |
| 2002/0066690 | A1 | * | 6/2002 | Mattis et al. | 206/532 |

FOREIGN PATENT DOCUMENTS

| | | |
|---|---|---|
| EP | 0547426 A1 | 6/1993 |
| JP | 9156675 A | 6/1997 |

* cited by examiner

*Primary Examiner*—Mickey Yu
*Assistant Examiner*—Steven A. Reynolds
(74) *Attorney, Agent, or Firm*—Barnes & Thornburg LLP

(57) ABSTRACT

Apparatus for releasing tablets from a blister pack has a tray, a lid pivotally mounted on the tray and a peg slidably mounted on the lid. A base is formed integrally with side walls of the tray, a raised floor for receiving the blister pack extends across the tray and is spaced from the base to define a cavity. A partition wall extends between the side walls at one end of the floor and includes a raised portion which defines a gap between the wall and floor which enables the cavity to communicate with an end receptacle defined by the floor and a part circular end wall. The peg is movable into registry with any selected blister and the floor is provided with apertures to allow released tablets to pass through the floor into the cavity and from the cavity into the end receptacle.

6 Claims, 7 Drawing Sheets

APPARATUS FOR RELEASING TABLETS FROM A BLISTER PACK

FIELD OF THE INVENTION

This invention relates to apparatus for releasing tablets from a blister pack containing a plurality of tablets, each held in a respective blister, and to such apparatus for use with a blister pack in which the blisters are arranged in two rows.

BACKGROUND TO THE INVENTION

It is common for medicament supplied in tablet form to be packaged in a blister pack. Such a pack typically comprises an upper sheet of semi-rigid plastics material in which the blisters are formed, and a lower sheet of sealing foil which closes the blisters. In order to release a tablet from a blister, the pack has to be held with the underside of the blister spaced from any supporting surface and a collapsing force needs to be exerted on the blister. If such a force is sufficiently large, it will cause the portion of the foil sealing the blister to rupture, thus releasing the tablet.

Although an able bodied person can easily release the blister from the pack without further assistance, a person of reduced manual dexterity can have difficulty exerting a sufficient collapsing force on a blister while properly supporting the blister pack.

EP-A-0759403 shows a tablet dispenser having a tray holding for a blister pack and a lid in which a number of buttons, each connected to a respective plunger, are provided. In use, each plunger overlies a respective blister so that, when the associated button is pushed, a tablet is ejected from that blister by the plunger. Since the number of buttons has to correspond to the number of blisters in a pack, the buttons are small and therefore difficult to use.

EP0547426A shows a tray like container having a lid which is provided with a single plunger slideable along a race so that it can move into engagement with any selected one of the blisters in a pack held in the tray. However, the top of the plunger is still relatively small and therefore difficult to operate.

SUMMARY OF THE INVENTION

According to a first aspect of the invention, there is provided apparatus for releasing tablets from a blister pack containing a plurality of tablets, each held in a respective blister, the apparatus comprising receiving means for receiving a blister pack, the receiving means having a lid moveable between an open and a closed position, the apparatus further comprising an abutment member mounted on the lid, the arrangement being such that movement of the lid from the open to the closed position, in use, causes the abutment member to engage, and release a tablet from, a blister in registry with the abutment member.

Thus the invention provides apparatus which can release a tablet from a blister pack in the apparatus simply by closing the lid. Once the lid has been closed, no further manipulation of the apparatus is required in order to release the tablet.

Preferably, the receiving means, comprises a tray, and the lid may to advantage be pivotally mounted on the tray.

The abutment member is preferably so mounted on the lid that the perpendicular distance from the outboard end of the abutment member to the portion of the lid on which it is mounted remains substantially fixed. This helps to ensure that most of the closing force exerted on the lid by a user is transmitted to the abutment to the blister.

The abutment preferably comprises a peg which is slideably mounted on the lid so as to be moveable, in use, into registry with any selected one of a plurality of blisters in a pack in the tray.

This enables the tray to be used as a container for the blister pack since the pack does not need to be re-positioned in the tray each time a tablet is to be released. Instead, it is simply necessary to move the peg into registry with the next full blister.

Preferably, the apparatus includes location means for providing a series of detent positions for the peg relative to the lid, each said position of the peg being in registry, in use, with a respective blister.

Preferably the location means comprises a series of formations which are in a fixed position relative to the lid and matingly engage the peg.

Preferably, the peg comprises a resiliently compressible portion for engaging said formations.

The formations may conveniently be integrally formed with the lid.

The tray may to advantage have a floor in which there is provided a plurality of apertures, each for allowing a tablet released from a respective blister overlying the aperture to pass through the floor, the peg thus being moveable into registry with any selected one of the apertures.

To that end, the peg is preferably slideably mounted in a guide way on the underside of the lid.

Typically, the blisters of a blister pack are arranged in two parallel rows. Some blister packs have a large number of parallel rows, but may be divided into sub packs, each of two rows of blisters, for example by tearing along the lines of weakening provided.

The apertures are therefore conveniently arranged in two parallel rows, to correspond to the arrangement of blisters in a pack, in which case the key way may comprise two main runs, each in registry with a respective row of apertures, interconnected by a run not in registry with any aperture.

It should also be noted that apparatus may be configured to accept blister packs having more than two rows of blisters, in which case the rows of apertures are two of three of more rows, the key way comprising three or more runs, each in registry with a respective aperture, each pair of neighbouring runs being interconnected by a respective interconnecting run not in registry with any aperture.

The position of the or each interconnecting run is therefore such that the peg can only eject tablets when in either or any of the main runs.

This latter of feature is of advantage whether the peg is axially fixed to the lid or whether it needs to be operated by means of a separate button once the lid has been closed.

The invention therefore also lies in apparatus for releasing tablets from a blister pack having two rows of blisters each containing a respective tablet, the apparatus comprising a tray, the floor of which has aperture means in registry, in use, with the two rows of blisters for allowing released tablets to pass through the tray floor, the apparatus further comprising a peg mounted on a lid of the tray for engaging a blister to release the tablet therefrom, the peg being slideable along a key way in the lid to enable the peg to moved be into registry with any selected one of the blisters of a pack in the tray, wherein the key way has two main runs in registry with the aperture means and an interconnecting run which interconnects the two main runs to allow the peg to be transferred from one to the other of the main runs, and which is not in registry with the aperture means.

Preferably, the aperture means comprises two rows of apertures, each aperture being in registry with a respective blister when a blister pack is held in the device.

BRIEF DESCRIPTION OF THE DRAWINGS

The invention will now be described, by way of example only, with reference to the accompanying drawings in which.

Figure 1:
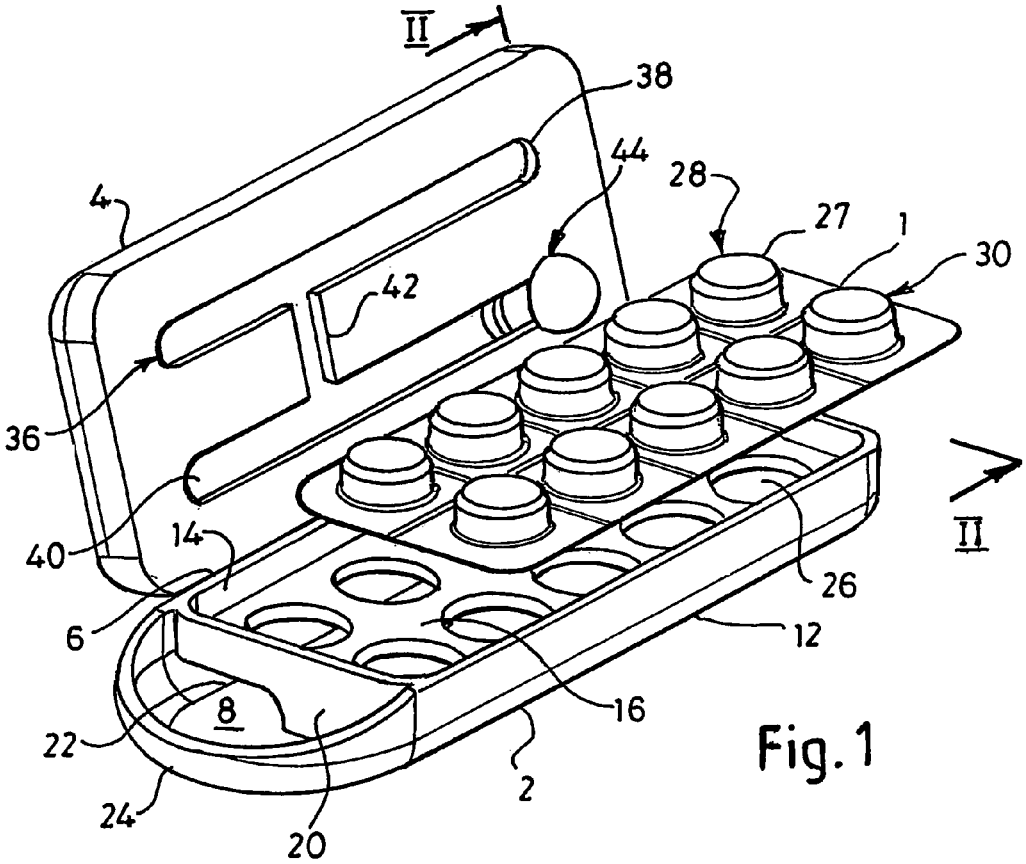
FIG. 1 is an isometric view of apparatus in accordance with the invention, the apparatus being shown with a lid in its partially opened condition and a blister pack ready to be placed in the apparatus.
Figure 2:
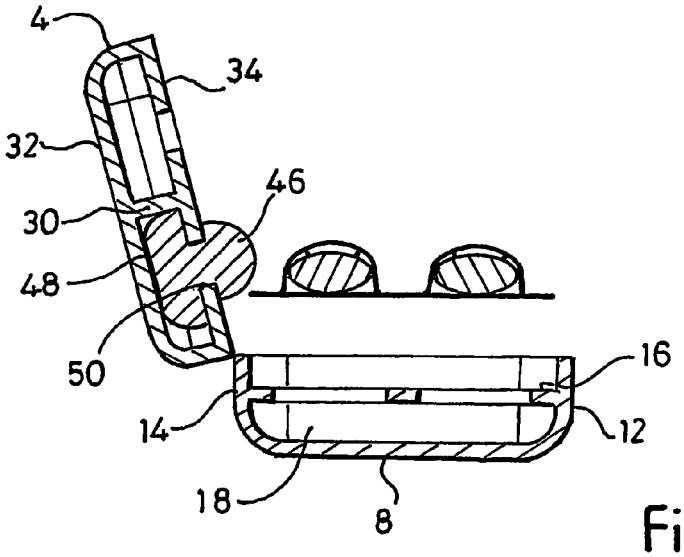
FIG. 2 is a sectional end view of the apparatus as shown in FIG. 1.
Figure 3:
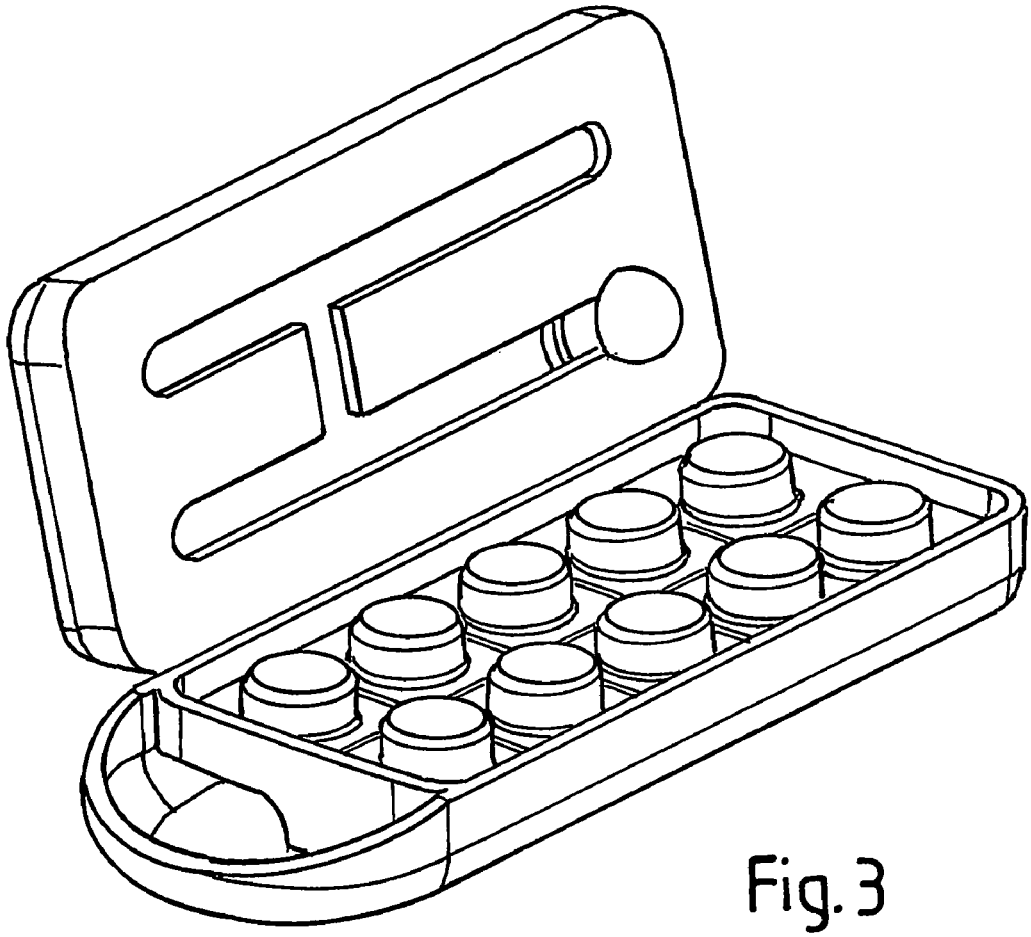
FIGS. 3,5,7 and 9 are views corresponding to FIG. 1 and showing the apparatus at a number different stages during its operation.
Figure 4:
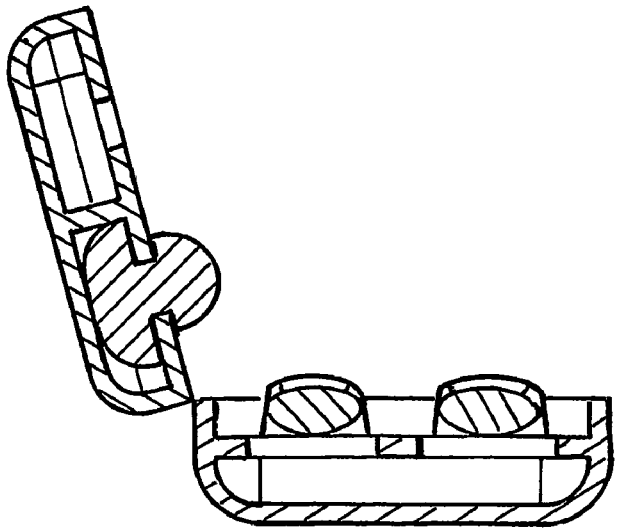
Figure 5:
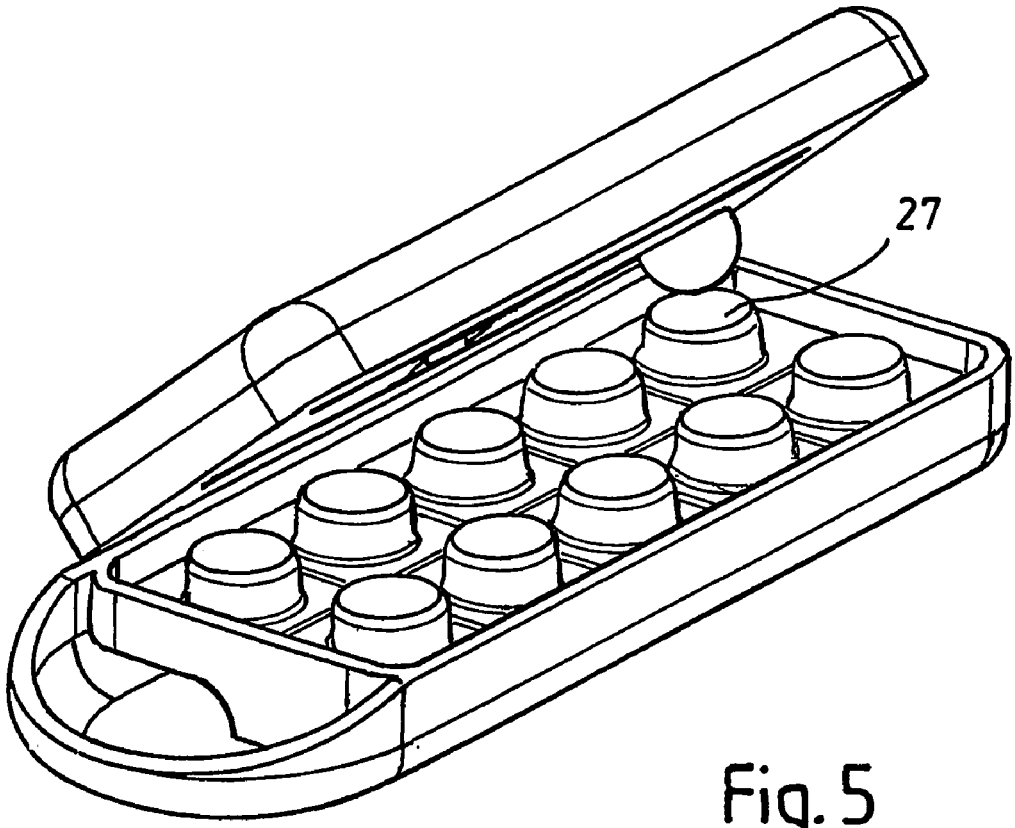
Figure 6:
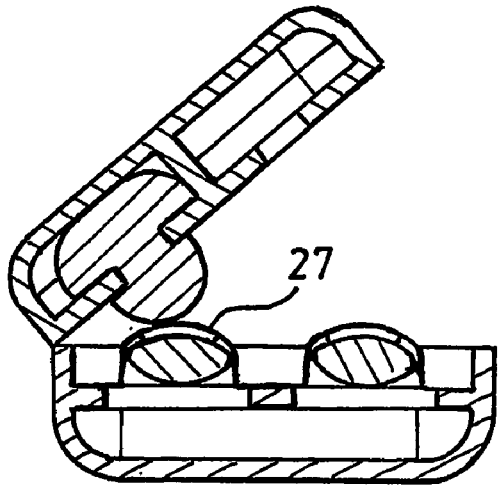
Figure 7:
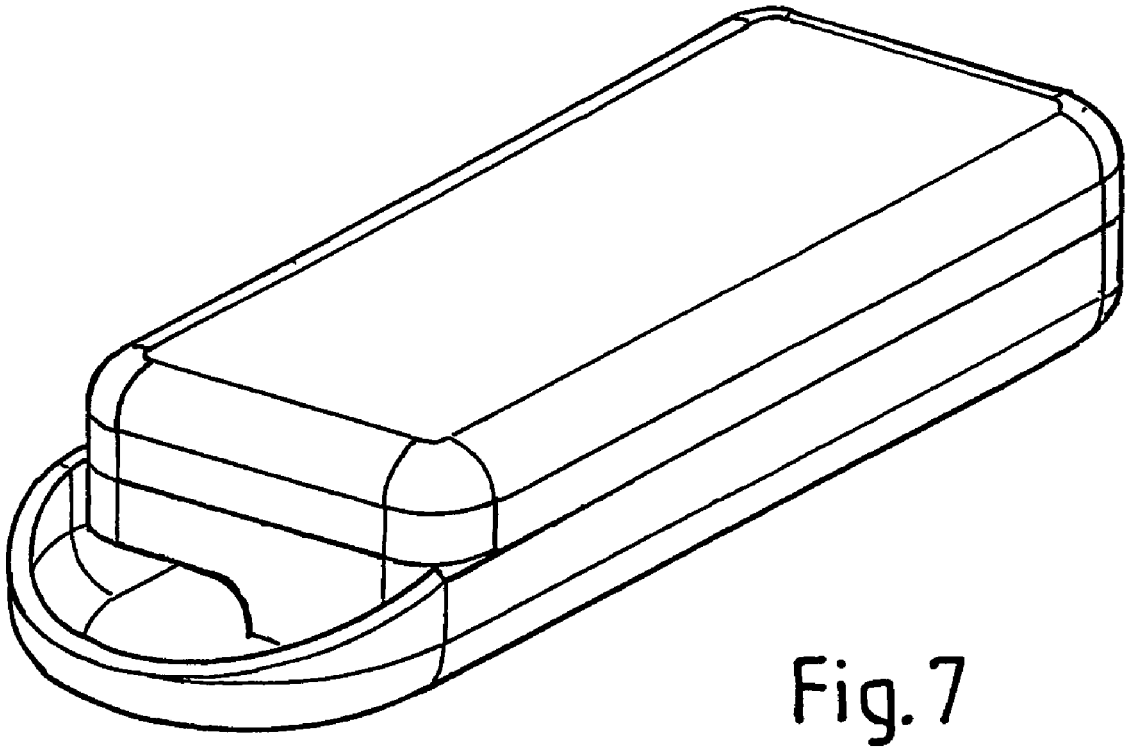
Figure 11:
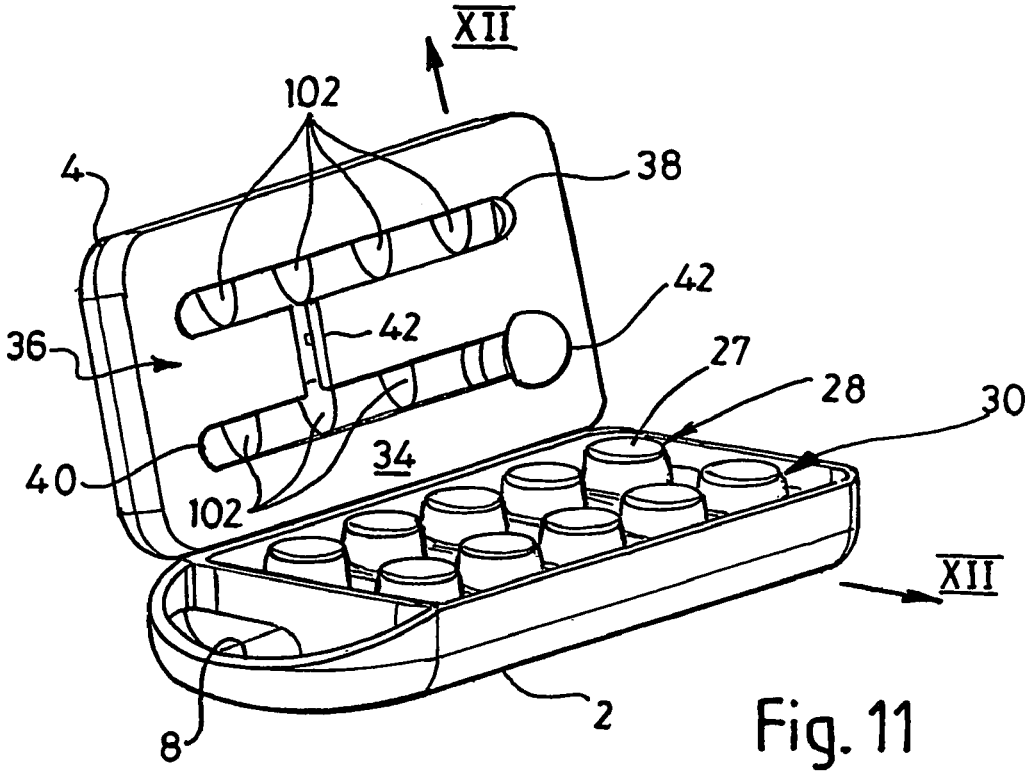
Figure 12:
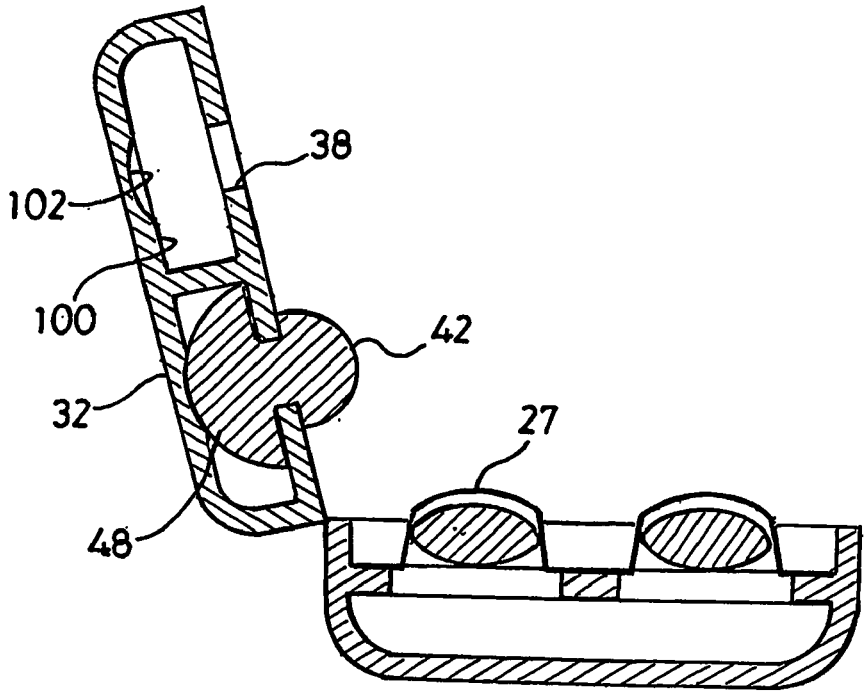
Figure 13:
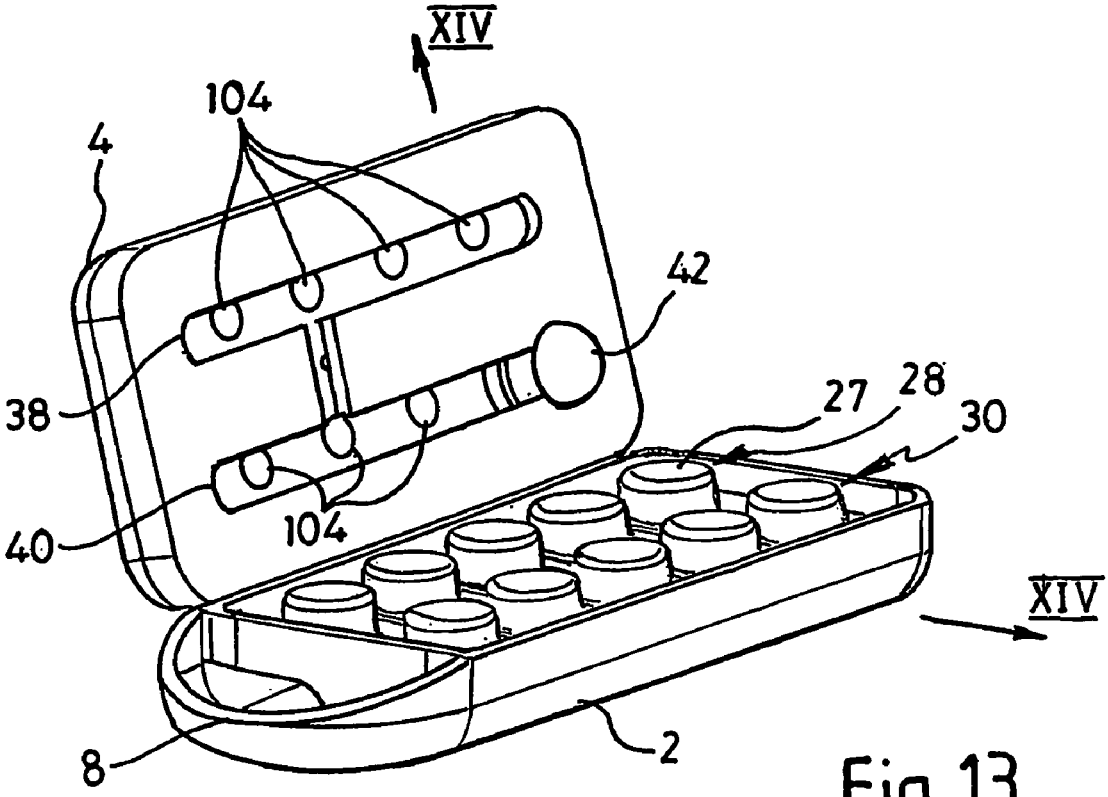
Figure 14:
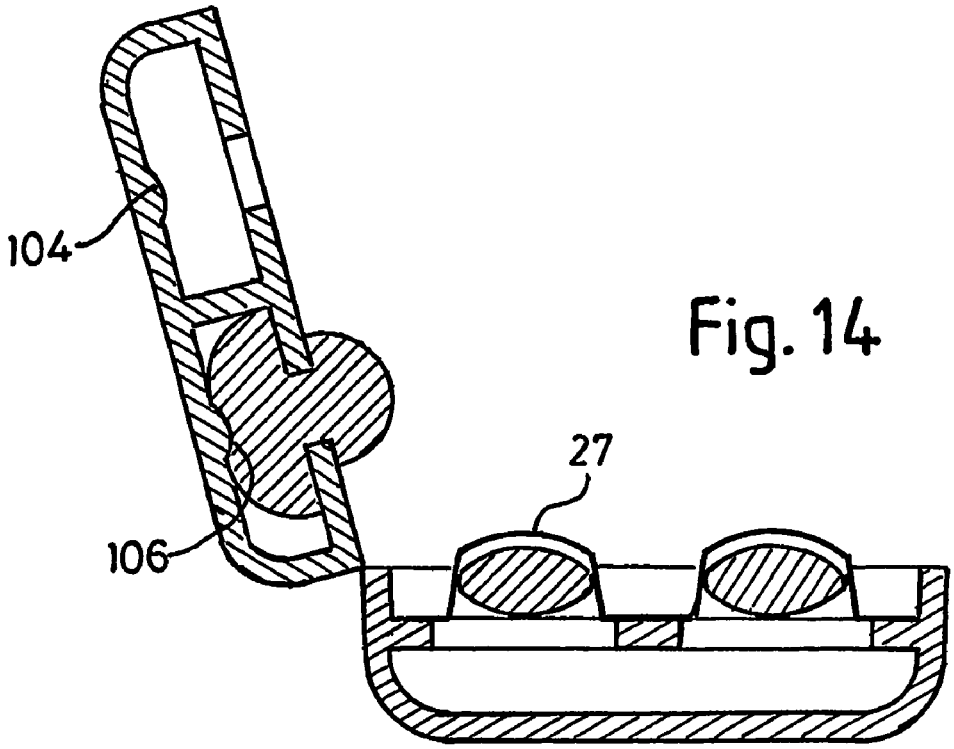

Each of FIGS. 4,6,8 and 10 is a sectional side view, corresponding to FIG. 2, of the apparatus at the stages of operation shown respectively in FIGS. 3,5,7 and 9;

FIGS. 11 and 12 are views, respectively corresponding to FIGS. 1 and 2, of a second embodiment of apparatus in accordance with the invention; and FIGS. 13 and 14 are views, respectively corresponding to FIGS. 1 and 2, of a third embodiment of apparatus in accordance with the invention.

DETAILED DESCRIPTION

With reference to FIGS. 1 and 2, apparatus for releasing tablets from a blister pack, referenced 1, comprises a tray 2 and a lid 4 which is pivotally connected along one side to the tray 2 so that the lid 4 can pivot about an axis defined by the side 6 of the lid 4.

FIG. 2 is a sectional view along the plane II indicated in FIG. 1, and shows that the tray 2 has a bottom 8 which is formed integrally with the side walls 12 and 14 of the tray. A raised floor 16 extends horizontally across the tray between the walls 12 and 14, and is spaced from the base 8 to define a cavity 18. A vertical partition wall 20 also extends between the walls 12 and 14 and is disposed at one end of the floor 16. The partition wall 20 includes raised portion 22 which defines a gap between the partition 20 and the floor 8 so as to enable the cavity 18 to communicate with an end receptacle defined by the floor 8 and a part circular end wall 24.

The floor 16 includes ten circular apertures, such as the aperture 26, arranged in two rows, each of five apertures. Each row corresponds to one of two rows 28 and 30 of blisters in the pack 1.

As can be seen from FIG. 2 the lid 4 is hollow, and is internally divided along its length by means of a rib 30 which is integral with an upper portion 32 of the lid 4 and lid's bottom 34. The bottom 34 takes the form of a plate in which there is provided a guide way 36 comprising a generally H-shaped slot. The guide 36 has two main straight parallel runs 38 and 40 interconnected by a cross run 42 extending perpendicularly to the two main runs. As can be seen from FIG. 1, there is an interruption in the rib 30 at the run 42. In an alternative embodiment the guide way comprises a U shaped slot. The guide way 36 slideably retains a peg generally referenced 44 having a domed tip 46 and a generally part spherical head 48 connected by a neck 50. The head 48 has a diameter which is larger than the width of any of the runs of the key way 36 and is situated in the space between the bottom 34 and upper portion 32 of the lid 4. The tip 46 also has a larger diameter than the width of any run. Thus the peg 44 is securely, but slideably retained on the lid 4.

When the lid 4 is closed, each of the runs 38 and 40 overlies a respective one of the rows of apertures in the floor 16, whereas the run 42 overlies the portion of the floor 16 between adjacent pairs of apertures in the rows.

In use, the blister pack 1 is placed in the tray 2 so that it is supported on the floor 16 with each of the rows 28 and 30 of blisters overlying the corresponding row of apertures in the floor 16. The spacing of the apertures is such that each blister is aligned, and hence in registry with a respective aperture.

The lid is then pivoted above the axis 6 towards its closed position. This brings the tip 46 of the peg 44 into contact with the blister 27. As the user continues to close the lid, until it reaches its fully closed position shown in FIGS. 7 and 8, the peg 44 exerts an increasing collapsing force on the blister 27 until the seal on the underside of the blister is ruptured so that the tablet in the blister falls through the corresponding aperture in the floor 16, as shown in FIG. 8.

The largest diameter of the tip 46 of the peg 44 is less than the diameter of the blister. This prevents the peg 44 engaging the blister directly over its circumferential side wall (referenced 50 in FIG. 8). It has been found that, if a collapsing force is exerted over an area large enough to include the side wall, the wall provides very effective resistance to the desired collapse of the blister. Thus, having a smaller peg avoids the problem of the blister presenting too much resistance to the collapsing force.

Figure 8:
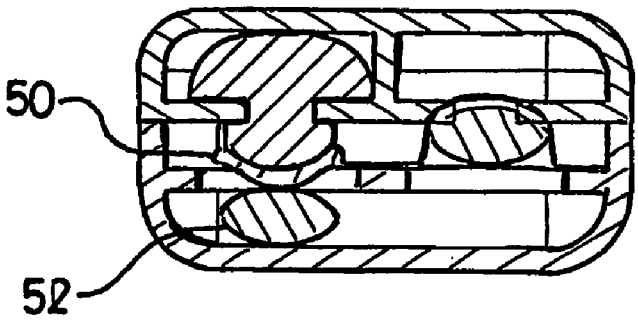

The tablet released from the blister 27 is shown at 52 in FIG. 8 in the cavity 18. If the apparatus is tilted appropriately, the tablet 52 will fall along the cavity 18 and out through the gap between the end wall 20 and base 8 and into the receptacle defined by the base 8 and the wall 24.

Figure 9:
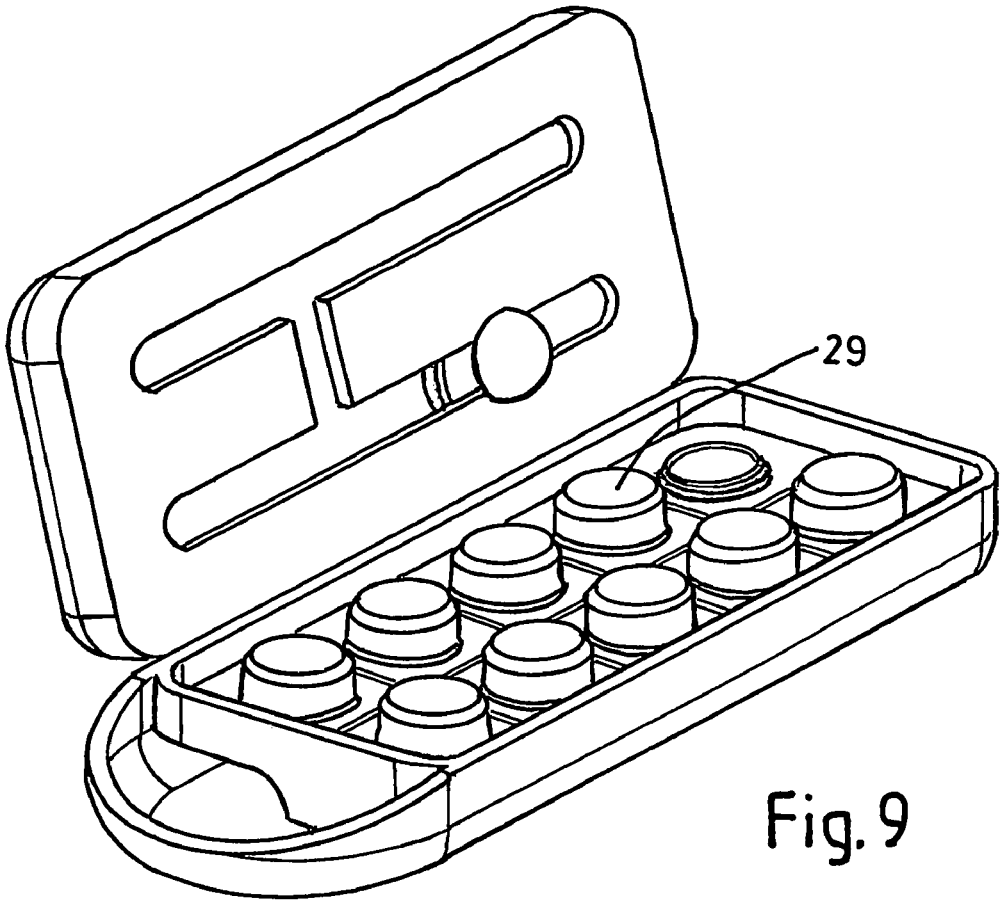
Figure 10:
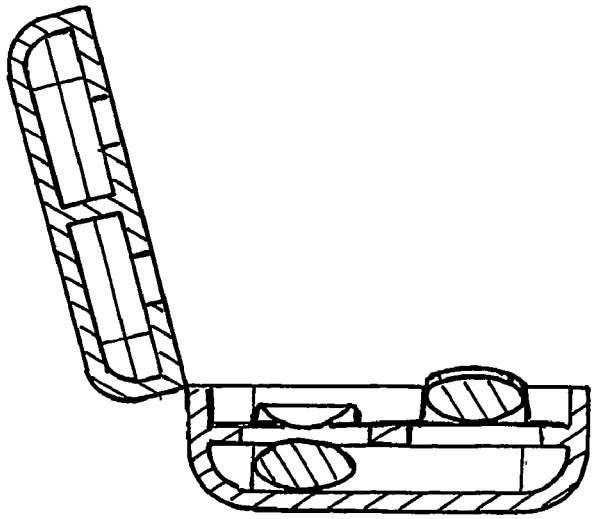

In order to dispense the next tablet, the user opens the lid and moves the peg along the run 40 into the position shown in FIG. 9, in which the peg is registry with the next blister 29. The process is then repeated. The peg 44 can be moved along the run 40 so that it is in registry with each of the blisters in the row 28 in turn. Once all the blisters in that run have been emptied, the peg 44 can be moved back into alignment with the run 42 and across into the run 38 so that the pills in the row 30 can be released in a similar manner. The positioning of the run 42 is such that, when the peg is in that run, it is not properly in registry with any blister so that closing the lid with the peg in this position does not dispense any tablets.

With reference to FIGS. 11 and 12, the second embodiment of apparatus is similar in many respects to the first embodiment, and the reference numerals of the preceding drawings are therefore are therefore use to denote the corresponding components of the second embodiment and the blister pack.

Thus, for example the second embodiment has a lid 4 which is hinged to a tray 2, and which has a guide-way 36 in which a slideable peg 42 is held captive. In the second embodiment however, the peg 42 is formed from a hard rubber so that its head 48 is resiliently compressible. Furthermore, the lower face 100 of the top of the lid carries formations constituted by two linear arrays of part spherical indentations, 102, integrally formed with the lid. As can be seen from FIG. 12, the curvature of the head 48 is the same as that of the indentations 102 so that, when in alignment with an indentation the head 48 is snugly seated therein. However, movement of the head out of an indentation will result is compression of the head. Thus the indentations 102 co-operate with the head 48 to provide a series of detent positions. These assist in the correct alignment of the peg with a blister since each indentation is aligned with a respective hole in the floor 16, when the lid 2 is closed.

The reference numerals used in FIGS. 13 and 14 have been allocated in the same manner as the reference numerals of FIGS. 11 and 12. The third embodiment of apparatus differs from the second embodiment only in that the lid 4 carries two linear arrays of part spherical protuberances 104 (instead of the indents 102) and in that the top of the head 48 is countersunk (at 106) to provide a part-spherical recess of the same radius as each protuberance. Thus the protuberances 104 and countersunk head 48 co-operate to provide a series of detent positions for the peg 42, each position being in registry with a respective aperture in the floor 16.

The invention claimed is:

1. Apparatus for releasing tablets from a blister pack containing a plurality of tablets, each held in a respective blister, the apparatus comprising a tray for receiving a blister pack, the tray having a lid pivotally mounted on the tray and moveable between an open and closed position, the apparatus further comprising a peg which is slideably mounted on the lid so as to be moveable, in use, into registry with any one of a plurality of blisters of a pack in the tray, wherein the tray has a base which is formed integrally with sidewalls of the tray, a raised floor extends horizontally across the tray between the sidewalls and is spaced from the base to define a cavity, a vertical partition wall extends between the sidewalls and is disposed at one end of the floor, the partition wall includes a raised portion which defines a gap between the partition wall and floor so as to enable the cavity to communicate with an end receptacle defined by the floor and a part circular end wall, the floor being provided with a plurality of apertures, each aperture allowing a tablet released from a respective blister overlying the aperture to pass through the floor, into the cavity and from the cavity into the end receptacle, the peg thus being moveable into registry with any selected one of the apertures.

2. Apparatus according to claim 1, wherein the peg is so mounted on the lid that the perpendicular distance from the outboard end of the peg to the portion of the lid on which it is mounted remains substantially fixed.

3. Apparatus according to claim 1, wherein the peg is slideably mounted in a key way on the underside of the lid.

4. Apparatus according to claim 3, wherein the apertures are arranged in two parallel rows, to correspond to the arrangement of blisters in a pack.

5. Apparatus according to claim 4 wherein the key way comprises two main runs, each in registry with a respective row of apertures, interconnected by a run not in registry with any aperture.

6. Apparatus for releasing tablets from a blister pack having two rows of blisters each containing a respective tablet, the apparatus comprising a tray, the floor of which has two rows of apertures, each aperture being in registry with a respective blister when a blister pack is held in the tray for allowing released tablets to pass through the tray floor, the apparatus further comprising a peg mounted on a lid of the tray for engaging a blister to release the tablet therefrom, the peg being slideable along a key way in the lid to enable the peg to be moved into registry with any selected one of the blisters of a pack in the tray, the lid being moveable between an open position and a closed position and the peg being arranged such that, with the peg in registry with a selected blister, movement of the lid from the open position to the closed position causes the peg to engage the selected blister to release a tablet therefrom, wherein the key way has two main runs, each main run being in registry with one of the rows of apertures, and an interconnecting run which connects the two main runs to allow the peg to be transferred from one to the other of the main runs, and which is not in registry with an aperture, and the largest diameter of the tip of the peg being less than the diameter of a blister.

* * * * *